US006332388B1

(12) United States Patent
Kishine et al.

(10) Patent No.: US 6,332,388 B1
(45) Date of Patent: Dec. 25, 2001

(54) ARBITRARILY POSITIONED LONGITUDINAL PERFORATION FORMING APPARATUS FOR FORM PRINTING MACHINE

(75) Inventors: Toshiaki Kishine; Hideo Izawa; Mikio Yoshikawa, all of Chiba (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 0 days.

(21) Appl. No.: 09/377,175

(22) Filed: Aug. 19, 1999

(30) Foreign Application Priority Data

Aug. 24, 1998 (JP) ..... 10-237293

(51) Int. Cl.[7] ..... B26D 1/26

(52) U.S. Cl. ..... 83/287; 83/289; 83/371; 83/425.4

(58) Field of Search ..... 83/286, 289, 295, 83/298, 303, 305, 311, 363, 365, 367, 368, 370, 371, 425.4, 498, 499, 287

(56) References Cited

U.S. PATENT DOCUMENTS

| | | | | |
|---|---|---|---|---|
| 3,283,636 | * | 11/1966 | Huck | 83/365 |
| 3,646,418 | * | 2/1972 | Sterns et al. | 83/549 |
| 3,847,045 | * | 11/1974 | Willhite, Jr. et al. | 83/37 |
| 3,899,945 | * | 8/1975 | Garrett et al. | 83/38 |
| 4,061,063 | * | 12/1977 | Brush | 83/55 |
| 4,095,084 | * | 6/1978 | Shutt | 219/121 |
| 4,202,229 | * | 5/1980 | Feldkamper | 83/304 |
| 4,214,495 | * | 7/1980 | Coburn | 83/425.4 |
| 4,226,149 | * | 10/1980 | Feldkamper et al. | 53/305 |
| 4,252,044 | * | 2/1981 | Yamashita et al. | 83/499 |
| 4,267,752 | * | 5/1981 | Byrt et al. | 83/74 |
| 4,380,945 | * | 4/1983 | Guild et al. | 83/482 |
| 4,548,109 | * | 10/1985 | Tokuno et al. | 83/71 |
| 4,604,934 | * | 8/1986 | Elliott et al. | 83/880 |
| 4,684,360 | * | 8/1987 | Tokuno et al. | 493/367 |
| 4,737,904 | * | 4/1988 | Ominato | 364/167 |
| 4,781,317 | * | 11/1988 | Ditto | 226/27 |
| 4,955,265 | * | 9/1990 | Nakagawa et al. | 83/74 |
| 5,083,487 | * | 1/1992 | Croteau | 83/29 |
| 5,097,732 | * | 3/1992 | Tahara | 83/76.01 |
| 5,099,734 | * | 3/1992 | Sugiyama et al. | 83/498 |
| 5,461,450 | * | 10/1995 | Long et al. | 354/354 |
| 5,720,223 | * | 2/1998 | Meschi | 101/227 |
| 5,735,184 | * | 4/1998 | Miller et al. | 83/504 |
| 5,761,980 | * | 6/1998 | Ima et al. | 83/500 |
| 5,787,780 | * | 8/1998 | Carter | 83/425.4 |

* cited by examiner

*Primary Examiner*—M. Rachuba
*Assistant Examiner*—Kim Ngoc Tran
(74) *Attorney, Agent, or Firm*—Wenderoth, Lind & Ponack, L.L.P.

(57) ABSTRACT

An arbitrarily positioned longitudinal perforation forming apparatus includes a longitudinal roulette cylinder composed of a first rotary shaft arranged on one side of a continuous web paper and at least one disc-shaped longitudinal roulette edge supported on the first rotary shaft so as to be adjustably positioned in an axial direction of the first rotary shaft. The apparatus further includes a receptacle cylinder composed of a second rotary shaft arranged on the other side of the continuous web paper in parallel relationship with the first rotary shaft and at least one disc-shaped edge receptacle plate supported so as to be adjustably positioned in an axial direction of the second rotary shaft. A projecting edge receptacle portion on the outer periphery of the edge receptacle plate opposes the longitudinal perforation edge of the longitudinal roulette cylinder. A drive system drives the first rotary shaft of the longitudinal roulette cylinder and the second rotary shaft of the receptacle cylinder in synchronism with the travel of the continuous web paper. An edge receptacle plate switchover moving device engages the edge receptacle plate to move the edge receptacle plate in the axial direction, and a first control unit controls the edge receptacle plate switchover moving device.

4 Claims, 10 Drawing Sheets

ARBITRARILY POSITIONED LONGITUDINAL PERFORATION FORMING APPARATUS FOR FORM PRINTING MACHINE

BACKGROUND OF THE INVENTION

1. Field of the Invention

The present invention relates generally to a longitudinal perforation forming apparatus for a form printing machine. More particularly, the invention relates to an arbitrarily positioned longitudinal perforation forming apparatus for forming a longitudinal perforation at an arbitrary position or a selected position in a continuous web paper printed by a form printing machine, depending upon a printed image.

2. Description of the Related Art

Since a form printing machine prints by means of a plate cylinder having a predetermined peripheral length, printing on a continuous web paper repeatedly makes a print per predetermined length in a feeding direction of the continuous web paper. In other words, printing using the plate cylinder makes repeated prints of the same image. Then, when a lateral or cross line perforation aligned in a perpendicular direction to a longitudinal direction of the continuous web paper is formed in a part of the printed image of such repeated prints of the same image, it is typical to perform a formation of the perforation by means of a perforation forming cylinder or a roulette cylinder having the same peripheral length as the plate cylinder in a similar manner to printing. In such conventional apparatus, the perforation formation is inherently performed sequentially and repeatedly for all printed images. Therefore, it has not been possible to form a longitudinal perforation only for a preliminarily selected image.

For example, in a longitudinal perforation forming apparatus composed of a roulette cylinder and a receptacle cylinder, a prior art apparatus which forms a longitudinal perforation for a part of the printed image is illustrated in FIGS. 11 and 12.

The apparatus shown in FIGS. 11 and 12 is called a skip roulette apparatus. The skip roulette apparatus has the receptacle cylinder a on the peripheral surface of which ribbon steels b are attached at mutually spaced apart positions with a predetermined distance in axial direction. At positions corresponding to respective ribbon steels b, longitudinal roulette rollers c are provided and are supported by holders d. Rotating the holders d according to rotation of the receptacle cylinder a to depress the longitudinal perforation rollers c onto the ribbon steels b forms a longitudinal perforation in the web paper e.

In the foregoing conventional skip roulette apparatus, the longitudinal perforation is formed in a part of the printed image by attaching the ribbon steel corresponding to the length of the longitudinal perforation on the receptacle cylinder a having the same peripheral length of a plate cylinder. However, it has not been possible to selectively form the longitudinal perforation. Also, since the position of the longitudinal perforation is fixedly determined depending upon the position where the ribbon steel is attached, varying the position or interval is difficult. Furthermore, in order to vary the position of the longitudinal perforation in the longitudinal direction (traveling direction of the continuous web paper), it becomes necessary to loosen a sleeve f supporting the receptacle cylinder a to manually adjust the longitudinal position. Such adjustment is not easy. Furthermore, it is difficult to change the number of longitudinal perforations, similarly.

SUMMARY OF THE INVENTION

The present invention has been worked out in view of the problem set forth above. Therefore, it is an object of the present invention to provide an arbitrarily positioned longitudinal perforation forming apparatus which can arbitrarily form the longitudinal perforation at only a preliminarily selected image, and can easily vary a position of the longitudinal perforation in a width direction of a continuous web paper. Furthermore, the apparatus can vary positions and interval of a plurality of longitudinal perforations in the width direction of the continuous web paper and further vary the number of the perforations, and can vary the position of the longitudinal perforation in a longitudinal direction (traveling direction of the continuous web paper).

In order to accomplish the above-mentioned object, an arbitrarily positioned longitudinal perforation forming apparatus according to the present invention comprises a longitudinal roulette cylinder, a receptacle cylinder, a driver system, and edge receptacle, and a first control unit.

The longitudinal roulette cylinder is composed of a first rotary shaft arranged on one side of a continuous web paper and which rotates in a traveling direction of the continuous web paper. At least one disc-shaped longitudinal roulette edge is supported on the first rotary shaft as adjustably positioned in an axial direction of the first rotary shaft and locked in a rotating direction.

The receptacle cylinder is composed of a second rotary shaft arranged on the other side of the continuous web paper in a parallel relationship with the first rotary shaft and which rotates in the traveling direction of the continuous web paper. At least one disc-shaped edge receptacle plate is supported so as to be adjustably positioned in an axial direction of the second rotary shaft and locked in a rotating direction. The disc-shaped edge receptacle plate is provided with a projecting edge receptacle portion opposing the longitudinal roulette edge of the longitudinal perforation cylinder on its outer periphery. A longitudinal perforation is formed in the continuous web paper when the projecting edge receptacle portion opposes the longitudinal roulette edge.

A drive system drivers the first rotary shaft of the longitudinal roulette cylinder and the second rotary shaft of the receptacle cylinder in synchronism with the direction of travel of the continuous web paper. The edge receptacle plate switchover moving device engage the edge receptacle plate so as to move the edge receptacle plate in the axial direction. Finally, the first control unit controls the edge receptacle plate switchover moving device.

In addition to the construction set forth above, it is preferred that the apparatus further comprises a differential mechanism and a second control unit.

The differential mechanism is disposed in an element of the drive system to vary a position at which the longitudinal perforation is formed in the traveling direction of the continuous web paper in the continuous web paper by making rotations of the longitudinal roulette cylinder and the receptacle cylinder synchronous with the travel of the continuous web paper by varying rotation of a differential shaft thereof. The second control unit controls rotation of the differential shaft of the differential mechanism.

Also, in the construction set forth above, it is desirable that the edge receptacle plate switchover moving device comprises a feeding screw, a sleeve, a shifting member, and a switching drive source.

The feeding screw extends in parallel to the second rotary shaft, and the sleeve threadingly engages the feeding screw so that it is prevented from rotating. The shifting member is fixed to the sleeve and engaged with the edge receptacle plate in the axial direction, and the switching drive source drives the feeding screw in forward and reverse directions under control of the first control unit.

Furthermore, in the construction set forth above, the apparatus may further comprises a mark sensor. The mark sensor reads a mark printed on the continuous web paper and inputs a mark read signal to the first control unit. The first control unit is responsive to the mark read signal so as to drive the edge receptacle plate switchover moving device to perform the formation of the longitudinal perforation.

With the construction set forth above, under control of the first control unit, the edge receptacle plate switchover moving device drives the shifting member to move so as to switch the position of the edge receptacle plate between the aligned position, where at the position of the edge receptacle plate matches with the position of the longitudinal roulette edge in the axial direction, and a position offset from the aligned position.

When the longitudinal roulette edge and the edge receptacle plate are matched in the axial direction, both are opposed. By rotations of both the longitudinal roulette edge and the edge receptacle plate, a longitudinal perforation is formed in the continuous web paper in the length of the edge receptacle portion of the edge receptacle plate in the circumferential direction.

Accordingly, by controlling the edge receptacle plate switchover moving device using the first control unit, it is possible to arbitrarily form the longitudinal perforation at a predetermined position in the traveling continuous web paper, namely at only a preliminarily selected image.

On the other hand, by controlling rotation of the differential shaft of the differential mechanism by the second control unit, a difference in phases between rotation of the longitudinal roulette edge and the edge receptacle plate and the travel of the continuous web paper is created. This difference makes the position where the roulette edge and the edge receptacle plate are placed in opposition in the rotating direction shift relative to the position of the continuous web paper in the traveling direction thereof. By this, the position where the longitudinal perforation is formed can be arbitrarily varied in the longitudinal direction (feeding direction of the continuous web paper).

On the other hand, in the edge receptacle plate switchover moving device, the movement of the shifting member which moves the edge receptacle plate is performed by rotating the feeding screw using the switching drive source so as to cause a movement of the sleeve threadingly engaged with the feeding screw.

Furthermore, the control of the switching drive source by the first control unit is performed by reading the mark printed on the paper by the mark sensor and inputting the read signal to the first control unit. By this, the longitudinal perforation can be formed at the selected position according to the preliminarily printed mark.

The position of the longitudinal perforation in the width direction of the continuous web paper can be arbitrarily varied by moving and adjusting the position of the longitudinal roulette edge and the edge receptacle plate in the axial direction. Also, the number of longitudinal perforations can be arbitrarily and selectively determined by selecting the number of longitudinal roulette edges and edge receptacle plates.

The present invention will be understood more fully from the detailed description given herebelow and from the accompanying drawings of the preferred embodiment of the present invention, which, however, should not be taken to be limitative to the invention, but are for explanation and understanding only.

DETAILED DESCRIPTION OF THE INVENTION

The present invention will be discussed hereinafter in detail in terms of the preferred embodiment of the present invention with reference to the accompanying drawings, i.e. FIGS. 1 to 10. In the following description, numerous specific details are set forth in order to provide a thorough understanding of the present invention. It will be obvious, however, to those skilled in the art that the present invention may be practiced without these specific details. In addition, well-known structures are not shown in detail in order to avoid unnecessarily obscuring the present invention.

Figure 1:
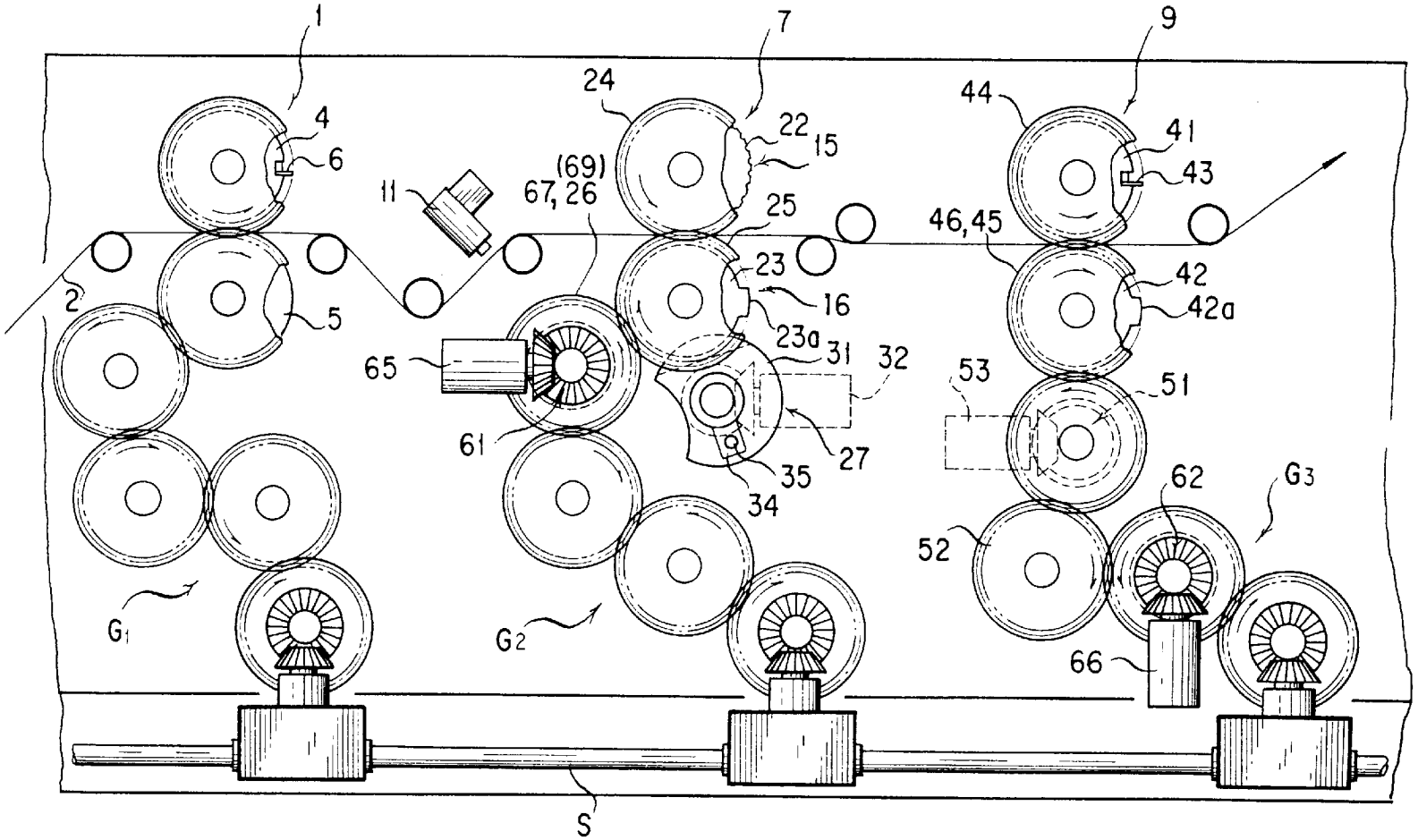
FIG. 1 is an explanatory illustration showing a general construction of a perforation forming section of a form printing machine including one embodiment of an arbitrarily positioned longitudinal perforation forming apparatus according to the present invention.
Figure 2:
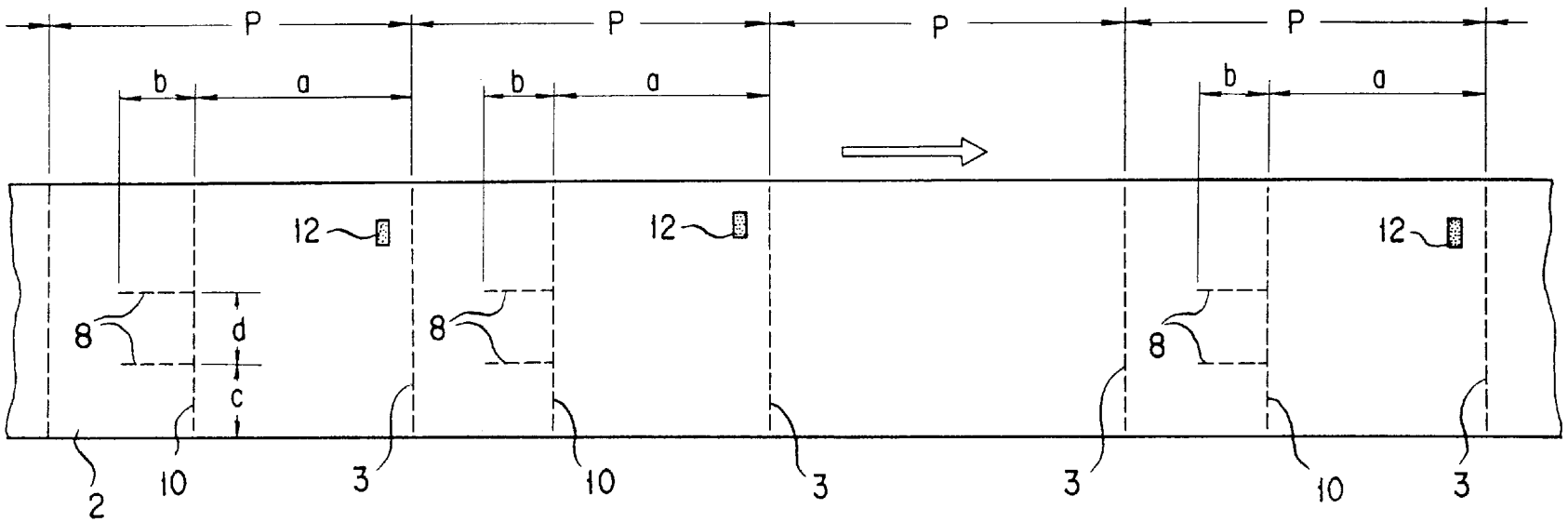
FIG. 2 is a plan view of one example of a continuous web paper to be perforated by the perforation forming section.

In the drawings, the reference numeral 1 denotes a fold line lateral perforation forming apparatus for forming a lateral perforation 3 for a fold line in a continuous web paper 2 which is fed sequentially, at predetermined intervals as shown in FIG. 2. The lateral perforation forming apparatus has a construction well known in the art and comprises a fold line lateral roulette cylinder 4 and a receptacle cylinder 5 rotating in synchronism with a traveling speed of the continuous web paper 2. The lateral perforation 3 for the fold line is formed per a given interval P in the continuous web paper 2 by means of a lateral roulette edge 6 fixed on the fold line lateral roulette cylinder 4 by cooperated rotations of both cylinders 4 and 5. Then, the lateral perforation forming apparatus 1 for the fold line is connected to a drive shaft S of a machine via a drive gear train (drive system) G1.

In the drawings, the reference numeral 7 denotes an arbitrarily positioned longitudinal perforation forming apparatus which is located downstream of the lateral perforation forming apparatus 1 for the fold line with respect to a traveling direction of the continuous web paper 2. The longitudinal perforation forming apparatus 7 forms a longitudinal or in-line perforation 8 aligned in the longitudinal direction of the continuous web paper, at an arbitrary position in the continuous web paper 2 along a traveling direction thereof.

On the other hand, in the drawing, the reference numeral 9 denotes an arbitrarily positioned lateral perforation forming apparatus which is located downstream of the arbitrarily positioned longitudinal perforation forming apparatus 7. The lateral perforations forming apparatus 9 lateral perforation 10 at an arbitrary position in the continuous web paper 2 along the traveling direction thereof.

Then, in the drawings, the reference numeral 11 denotes a mark sensor for reading a mark 12 preliminarily set by printing on the continuous web paper 2. The mark sensor 11 is provided on the upstream side of the arbitrarily positioned longitudinal perforation forming apparatus 7.

Next, the construction and function of the arbitrarily positioned longitudinal perforation forming apparatus will be discussed with reference to FIGS. 1 and 3 to 5. In the drawings, the reference numerals 15 and 16 are, respectively, a longitudinal roulette cylinder and a receptacle cylinder located in opposition across a traveling path of the continuous web paper 2.

A longitudinal roulette cylinder 15 is constructed with a first rotary shaft 19 supported on frames 17 and 18 on both sides, and a disc-shaped longitudinal roulette edge 20 fixed on the first rotary shaft 19 as positioned in an axial direction and provided with a roulette edge on its outer periphery. A plurality (for example two) of the longitudinal roulette edges 20 are provided with a predetermined interval d. Then, the longitudinal roulettes 20 are fixed by fastening screws 21. By loosening the fastening screws 21, the longitudinal roulettes 20 are movable in the axial direction. The longitudinal roulette 20 is locked on the first rotary shaft 19 in a rotating direction by means of a key 19*b*.

The receptacle cylinder 16 is constructed with a second rotary shaft 22 supported on frames 17 and 18 on both sides, and a disc-shaped edge receptacle plate 23 engaged with the second rotary shaft 22 slidably in an axial direction and provided with an edge receptacle portion 23*a* of projective step shape which contacts (or is placed in opposition to across a fine gap) the longitudinal roulette edge 20 of the longitudinal roulette cylinder 15. A plurality of the edge receptacle plates 23 of which number corresponds to the number of longitudinal roulette edges 20 (i.e., two) are engaged with the second rotary shaft 22. On the other hand, a length in the circumferential direction of the edge receptacle portion 23*a* of the edge receptacle plate 23 corresponds to a length b of the longitudinal perforation 8 shown in FIG. 2. The edge receptacle plate 23 is locked on the second rotary shaft 22 in the rotating direction by means of a key 22*b*.

The first and second rotary shafts 19 and 22 extend outwardly from one frame 17. On the extended portions of the first and second rotary shafts 19 and 22, mutually meshing gears 24 and 25 are integrally engaged, respectively, to rotate in mutually opposite directions. One gear 25 is meshed with an input gear 26 of a drive gear train G2 for forming the longitudinal perforation, and the drive gear train G2 is connected to the drive shaft S of the apparatus.

A switching moving device includes an edge receptacle plate moving device 27 and a servomotor 32. The edge receptacle plate moving device 27 moves the edge receptacle plate 23 in an axial direction. The edge receptacle plate moving device 27 includes a feeding screw 29 (threaded shaft), a sleeve 30, and at least one shifting member 31. The feeding screw 29 is rotatably supported on the frames 17 and 18 on both sides and has feeding thread 28 on the outer periphery. The sleeve 30 is threadingly engaged with the feeding thread 28 of the threaded shaft 29. The shifting member 31 is engaged with the sleeve 30 so as to be moveable in the axial direction. To the threaded shaft 29, the servo motor 32 (switching drive source) is connected. It should be noted that, in certain constructions of the servo motor 32, a speed reduction gear unit, such as a Harmonic Drive (trade name) which will be discussed later and can obtain a large reduction ratio, may be interposed between the servo motor 32 and the threaded shaft 29.

The shifting members 31, the number of which corresponds to number of edge receptacle plates 23, are engaged with the sleeves 30 with an interval d therebetween—the same as the interval of the edge receptacle plates 23, and is fixed to the sleeve by the fastening screws 33. The shifting members 31 are movable in the axial direction by loosening the fastening screws 33. From the sleeve 30, an arm 34 is projected in a direction perpendicular to the axial direction. A rotation stopper shaft 35 projected from one frame 17 in the axial direction is slidably engaged with the arm 34 in the axial direction.

Figure 3:
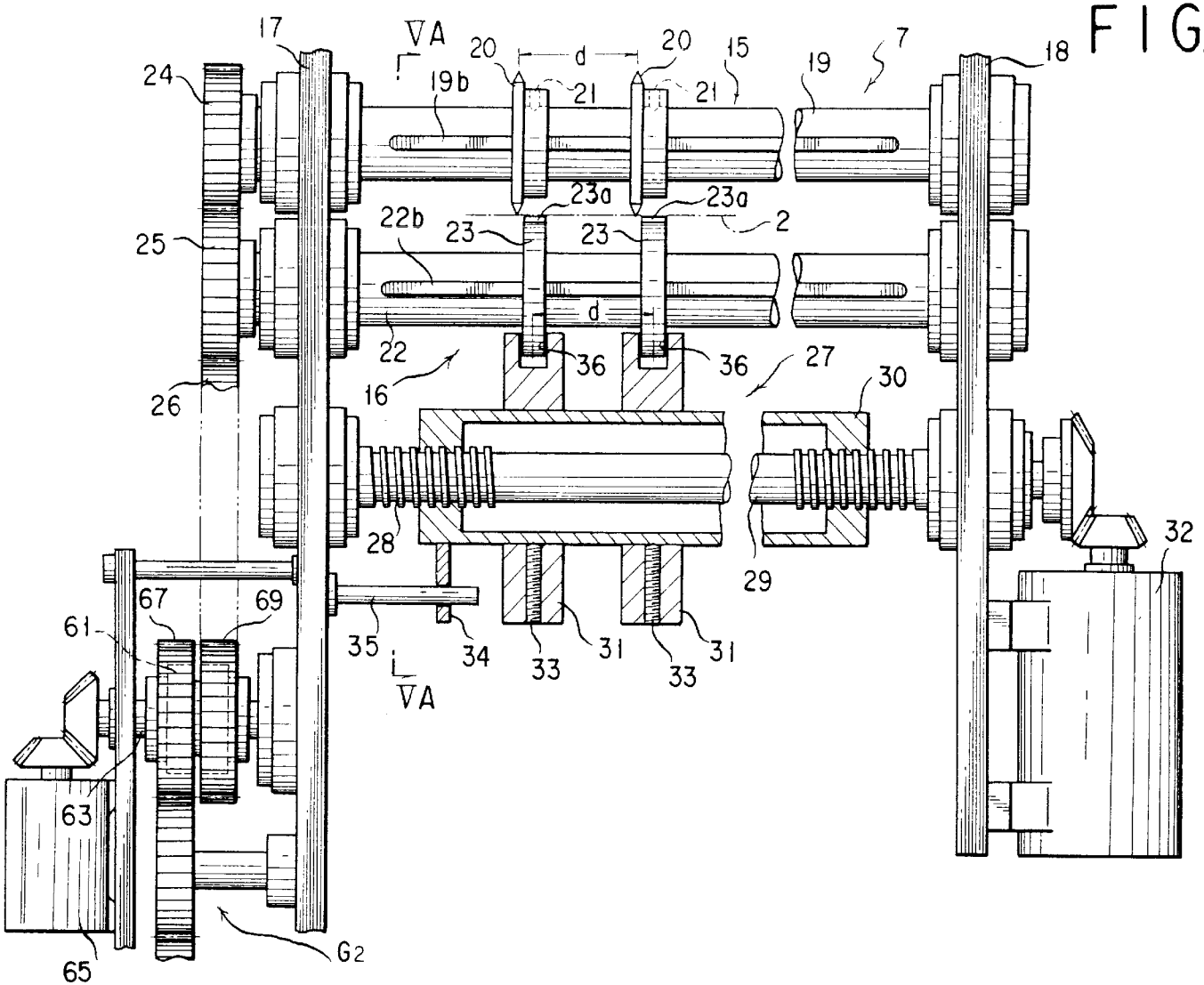
FIG. 3 is an explanatory illustration showing one embodiment of the arbitrarily positioned longitudinal perforation forming apparatus in the perforation forming section.
Figure 5B:
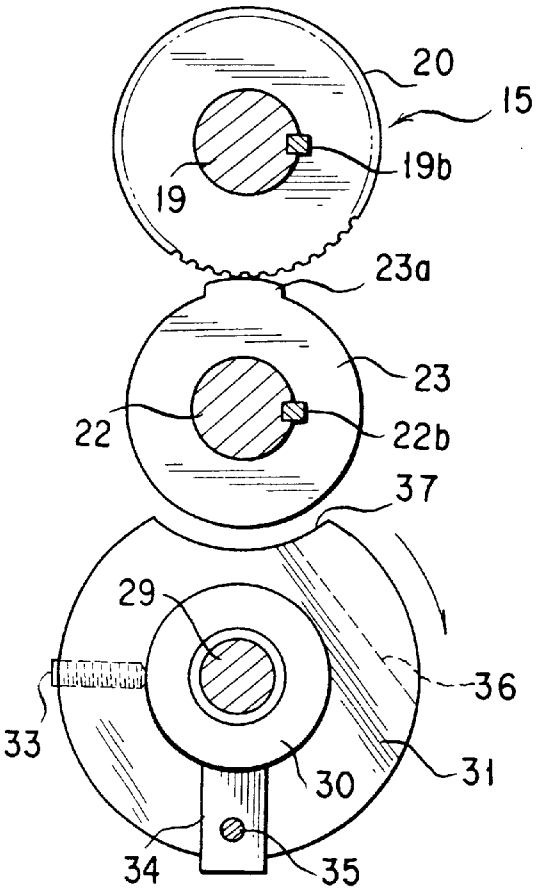
FIG. 5B is a section showing a condition where a shifting member is rotated in FIG. 5A.
Figure 5A:
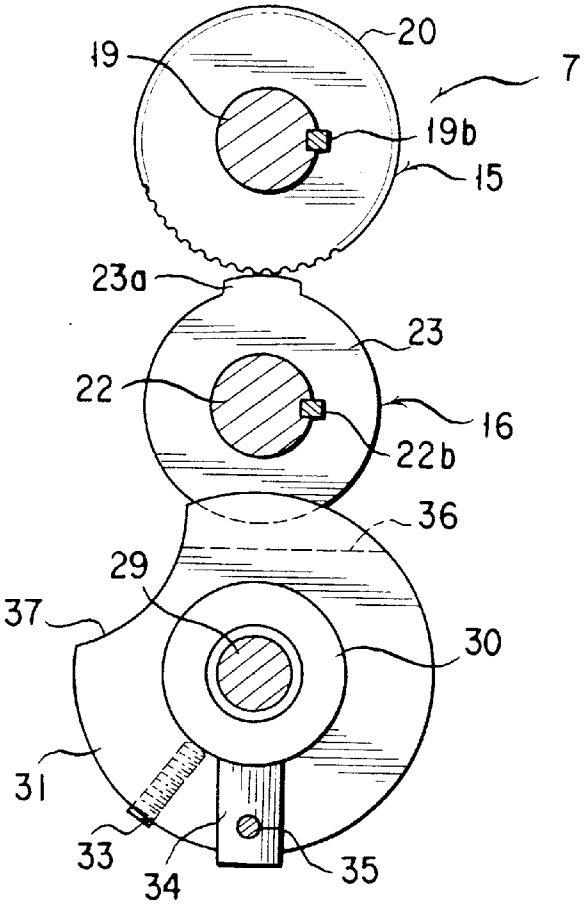
FIG. 5A is a section taken along line VA—VA of FIG. 3.

As shown in FIGS. 3. 5A and 5B, the shifting members 31 are provided with grooves 36 on parts of the peripheral edge portions, respectively. The grooves 36 are engaged with peripheral edge portions of the edge receptacle plates 23 so that the edge receptacle plates 23 are moved in the axial direction along the second rotary shaft 22 by axial movement of the shifting members 31. On the peripheral edge portions of the shifting members 31, cutouts 37 are provided at a portion adjacent to the groove 36 in the circumferential direction, and these cut-outs 37 do not cause interference with (i.e., engaged) the edge receptacle plates 23 in the axial direction, respectively. By rotating the shifting members 31 about the sleeve 30 as shown in FIG. 5B and thus placing the cut-outs 37 in opposition to the peripheral surface of the edge receptacle plates 23, engagements between the edge receptacle plates 23 and the shifting members 31 are released, respectively.

In the arbitrarily positioned longitudinal perforation forming apparatus 7, the gears 24 and 25 are driven in mutually opposite directions by rotation of the input shaft 26 of the drive gear train G2 for formation of the longitudinal perforation. In turn, the longitudinal roulette cylinder 15 and the receptacle cylinder are driven 16 to rotate at a peripheral speed at which the longitudinal roulette edges 20 and the edge receptacle plates 23 respectively match the feeding speed of the continuous web paper 2.

The edge receptacle plate 23 is normally offset in an axial direction relative to the longitudinal roulette edge 20. The threaded shaft 29 of the edge receptacle plate moving device 27 is driven to rotate by the servo motor 32 to move the sleeve 30 in the axial direction. Because the shifting members 31 integrally moving with the sleeve 30, the edge receptacle plates 23 are moved in the axial direction. Then, when the edge receptacle plates 23 are placed in opposition to the longitudinal roulette edges 20, the longitudinal perforation 8 is formed in the continuous web paper 2 over a length corresponding to the length of the edge receptacle portion 23*a* of the edge receptacle plate 23. Thereafter, when the edge receptacle plate moving device 27 is operated in the opposite direction by revolution of the servo motor 32 in reverse direction, the edge receptacle plates 23 are offset in the axial direction relative to the longitudinal roulette edges 20 so as not to form the longitudinal perforation 8.

The positions and interval of the longitudinal perforations 8 are determined by positions of the longitudinal roulette edges 20 and the edge receptacle plate 23 corresponding thereto. On the other hand, the number of longitudinal perforations 8 can be arbitrarily determined by the number of pairs of the longitudinal roulette edges 20 and the edge receptacle plates 23. Also, by placing some of a plurality of pairs of the longitudinal roulette edges 20 and the edge receptacle plates 23 at positions so as not to oppose each other, a part of a plurality of pairs of the longitudinal roulette edges 20 and the edge receptacle plates 23 may be placed in opposition to each other to permit a selection of the number of longitudinal perforations 8 to be formed.

Figure 4:
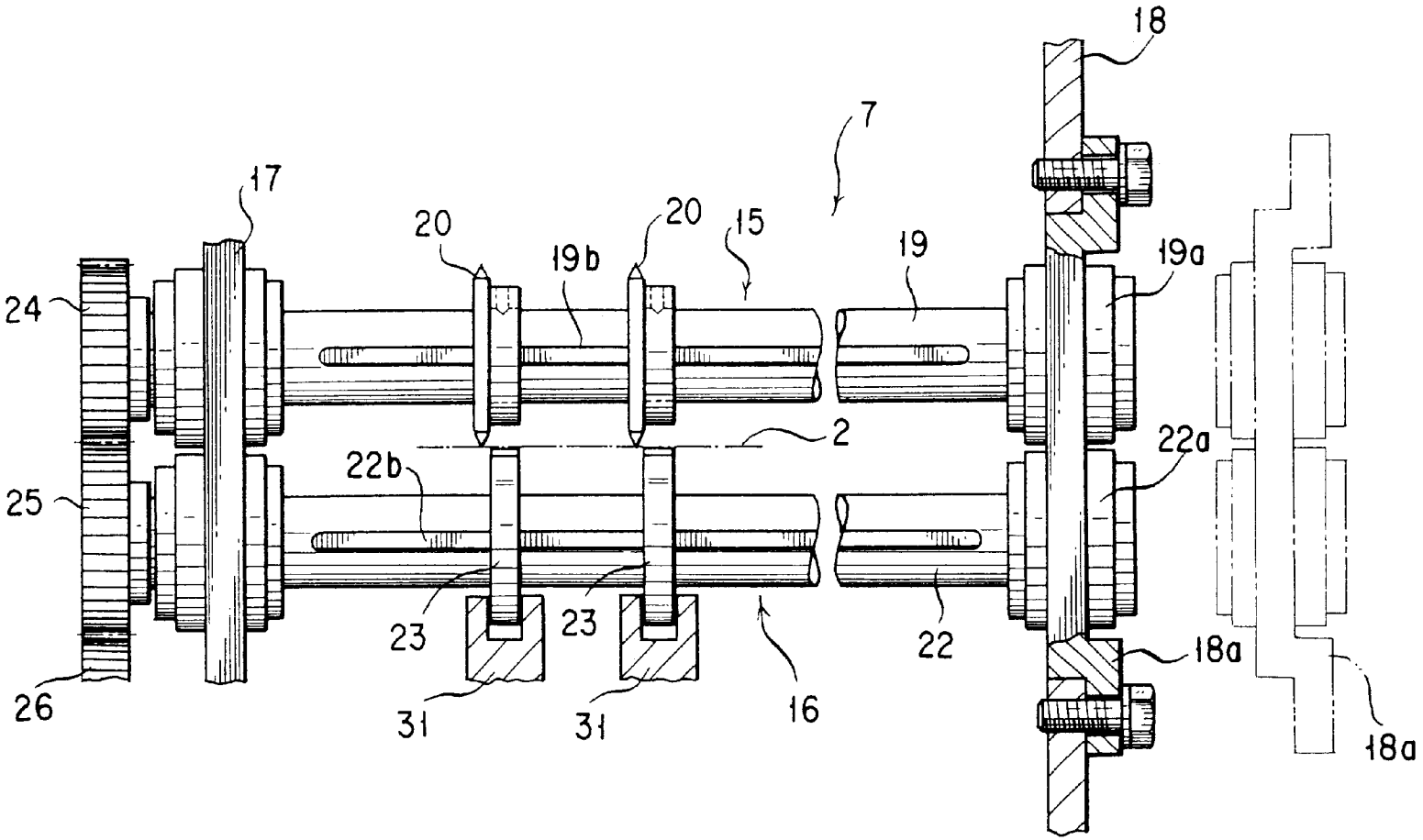
FIG. 4 is an explanatory illustration showing another embodiment of the arbitrarily positioned longitudinal perforation forming apparatus.

On the other hand, in the arbitrarily positioned longitudinal perforation forming apparatus 7, as shown in FIG. 4, respective first bearings 19*a* and 22*a* of the first and second rotary shafts 19 and 22 may be supported by a mounting plate 18*a* which is detachably connected to one frame 18. By removing the mounting plate 18*a* from the frame 18, the bearings 19*a* and 22*a* can be released from the first end portions of the first and second rotary shafts 19 and 22.

By the construction set forth above, the longitudinal roulette edges 20 and the edge receptacle plates 23 can be exchanged, and the number of these can be increased and decreased with respect to the first and second rotary shafts 19 and 22.

Next, construction and function of the arbitrarily positioned lateral perforation forming apparatus 9 will be discussed with reference to FIGS. 6 to 8. In the drawings, the reference numerals 41 and 42 denote a lateral roulette cylinder and a receptacle cylinder across the traveling path of the continuous web paper 2, respectively.

The lateral roulette cylinder. 41 is supported on the frames 17 and 18 on both sides. A lateral roulette edge 43 is fixed in a groove provided at the predetermined position of the outer peripheral portion of the lateral roulette cylinder 41 in a condition slightly projecting from the edge from the peripheral surface.

The receptacle cylinder 42 is supported on the frames 17 and 18 on both sides. On a part of the outer peripheral portion of the receptacle cylinder 42, an edge receptacle portion 42*a* contacting with (or opposing to with a fine gap) the tip end of the lateral roulette edge 43 is provided in a projecting stepped form over a small angular range, e.g. 5 to 15 in the circumferential direction. When the lateral roulette edge 43 is placed in opposition to the edge receptacle portion 42*a*, the lateral perforation 10 is formed in the continuous web paper 2 located therebetween.

Each supported portion of respective cylinders 41 and 42 on one frame 17 extend outwardly from the frame 17. On the shaft portions of the supported portions that extend outwardly from the frame 17, driven-gears 44 and 45 having equal number of gear teeth are fixed at mutually axially offset positions, respectively. On the other hand, on the shaft portion of the receptacle cylinder 42, an intermediate gear 46 meshing with the driven gear 44 of the lateral roulette cylinder 41 is rotatably supported, and the intermediate gear 46 has the same number of gear teeth as the driven gear 44.

A differential shaft 47 is supported on the frames 17 and 18 and an auxiliary frame 48 in the vicinity of the receptacle cylinder 42. A first gear 49 meshing with the driven gear 45 of the receptacle cylinder 42 and a second gear 50 meshing with the intermediate gear 46 are supported on the differential shaft 47 via a differential mechanism 51. Then, to the second gear 50, an input gear 52 connected to a drive gear train G3 for formation of lateral perforation is meshed, and the driven gear train G3 is connected to a, driving shaft S of the machine. To the differential shaft 47, a servo motor 53 is connected.

As the differential mechanism 51, the Harmonic Drive (trade name) may be employed, for example. The first and second gears 49 and 50 rotate integratedly in obedience to the rotation of the input gear 52. During rotation, by rotation of the differential shaft 47, rotation phases of the first and second gears 49 and 50 are shifted relative to each other to cause shifting of rotational phases of respective driven gears 44 and 45 of the lateral roulette cylinder 41 and the receptacle cylinder 42 relative to each other.

The Harmonic Drive used in the differential mechanism 51 is HDUD Type ZF. The construction of the harmonic drive as the differential mechanism is shown in FIG. 7. In FIG. 7, the reference numeral 54 denotes a web generator, 55 denotes a flex spline, 56 denotes a circular spline, 57 denotes a dynamic spline, 58 denotes a web generator bearing, 59*a* and 59*b* denote flanges, 60 denotes a ball bearing. On the web generator 54, an actuation shaft 47 is fixed. On one flange 59*a*, the first gear 49 is fixed. On the other flange 59*b*, the second gear 50 is fixed.

Figure 8A:
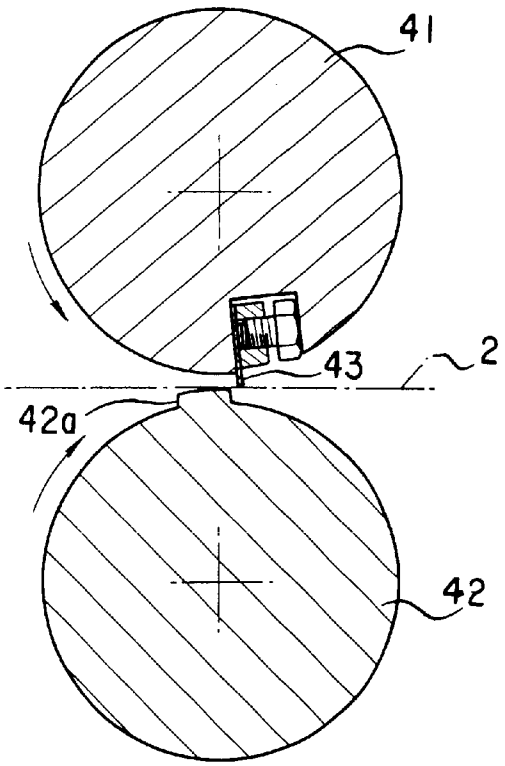
FIG. 8A is a section taken along line VIIIA—VIIIA of FIG. 6.

In the arbitrarily positioned lateral perforation forming apparatus 9, respective driven gears 44 and 45 are driven to rotate by rotation of the input gear 52 via both gears 50 and 49 of the differential mechanism 51, respectively. Then, the lateral roulette cylinder 41 and the receptacle cylinder 42 are driven to rotate at the same speed as the feeding speed of the continuos web paper 2 in the feed direction of the continuous web paper 2. The rotational phase of the receptacle cylinder 42 relative to that of the lateral roulette cylinder 41 is varied by the differential mechanism 51. The edge receptacle portion 42*a* is normally placed away from the lateral roulette edge 43 of the lateral roulette cylinder 41 as shown in FIG. 8A.

Figure 8B:
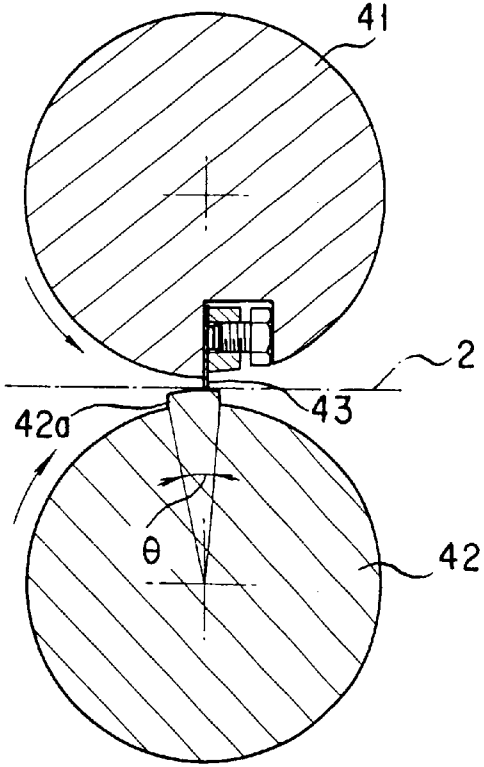
FIG. 8B is a section showing a condition where an edge receptacle portion of the receptacle cylinder is matched to a roulette edge of the lateral roulette cylinder.

In this condition, when the servo motor 53 is driven to rotate, the rotational phase of the first gear 49 is shifted relative to that of the second gear 50. When a direction that causes a phase shift is selected so that the rotational phase of the receptacle cylinder 42 is advanced relative to that of the lateral roulette cylinder 41, for example, the edge receptacle portion 42*a* of the receptacle cylinder 42 is placed in opposition to the lateral roulette edge 43, as shown in FIG. 8B. By this, the lateral perforation 10 is formed in the continuous web paper 2. By actuating the differential mechanism 51 in reverse direction, the edge receptacle portion 42*a* is again moved away from the lateral roulette edge 43 so that the lateral perforation is not formed thereafter.

The servo motor 32 of the arbitrarily positioned longitudinal perforation forming apparatus 7 and the servo motor 53 used in the arbitrarily positioned lateral perforation forming apparatus 9 have their rotation speed, number of rotations, and direction of rotation controlled by the control unit. Then, the mark 12 printed on the continuous web paper 2 is read by the mark sensor 11. When the signal from the mark sensor 11 is input to the control unit, the servo motors 32 and 53 are driven in predetermined rotating directions at predetermined rotation speeds for a predetermined number of turns after expiration of a predetermined period.

The receptacle cylinder 5 of the lateral perforation forming apparatus 1 for fold line, the input gear 26 of the arbitrarily positioned longitudinal perforation forming apparatus 7, and the input gear 52 of the arbitrarily positioned lateral perforation forming apparatus 9 are connected to the drive shaft S of the machine via respective drive gear trains (drive system) G1, G2 and G3, to be driven in synchronism with traveling speed of the continuous web paper 2, normally.

Figure 6:
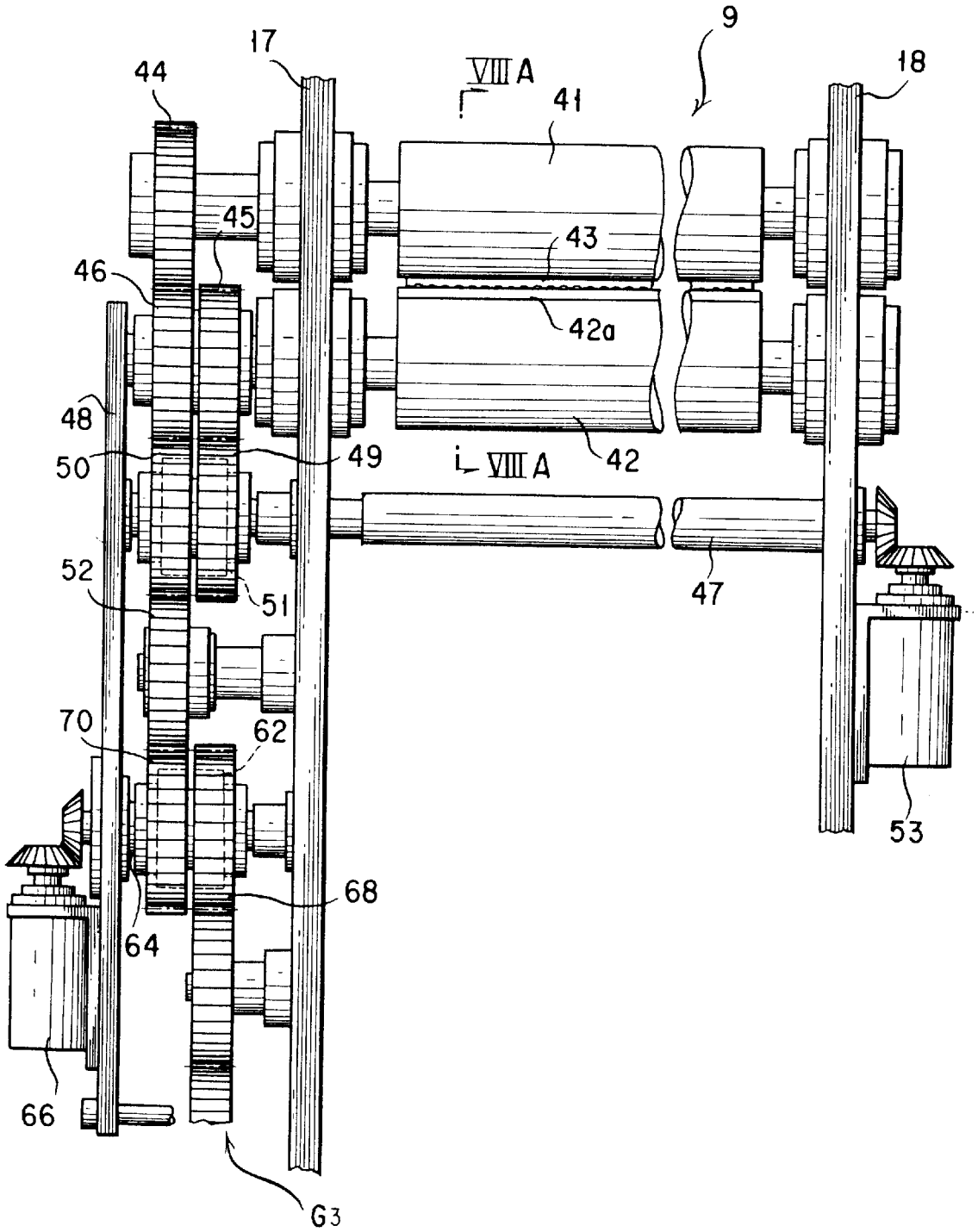
FIG. 6 is an explanatory illustration showing a construction of one example of the arbitrarily positioned lateral perforation forming apparatus in the perforation forming section.
Figure 7:
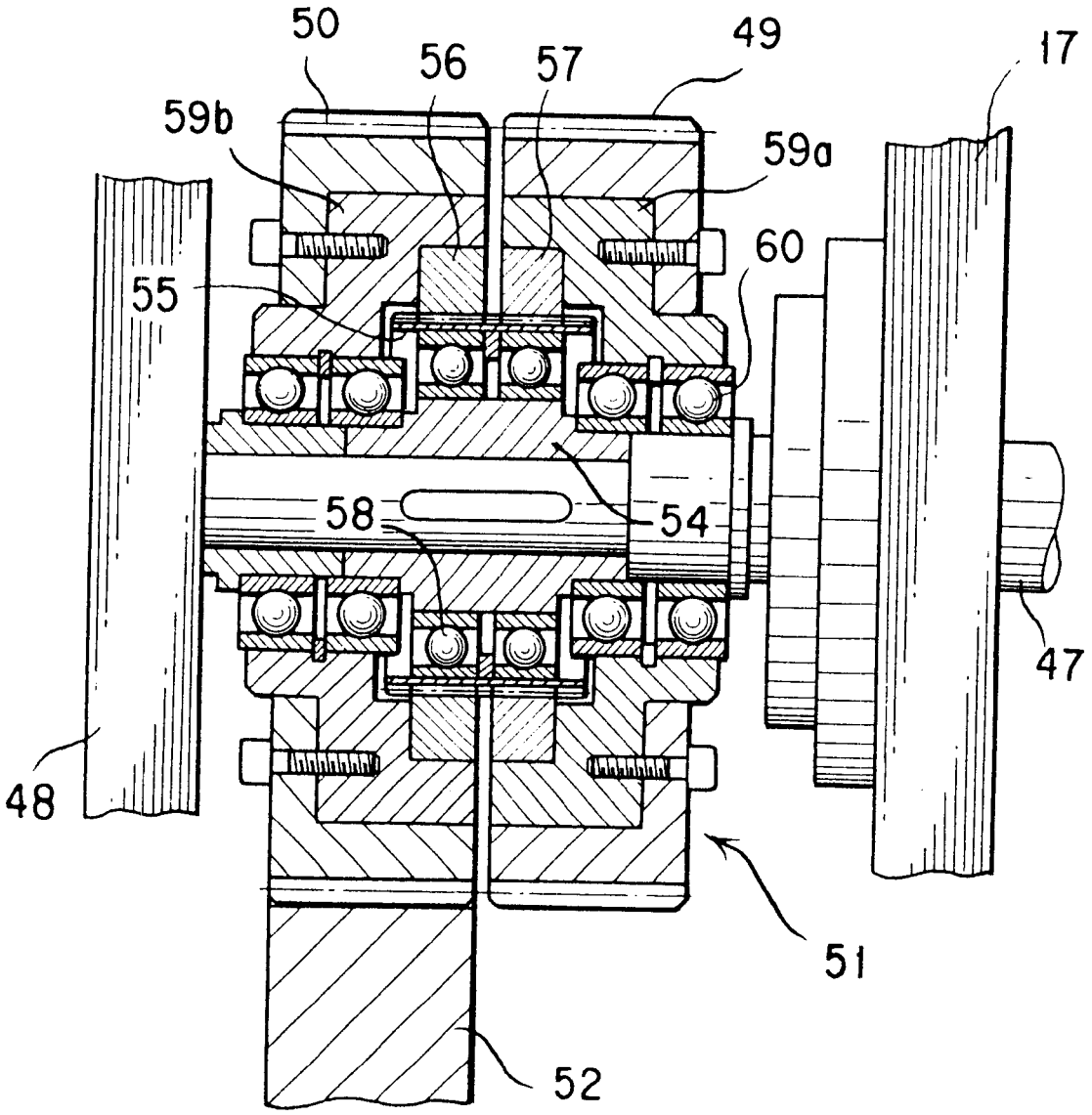
FIG. 7 is a section showing one example of a differential mechanism in the shown example.

In both drive gear trains G2 and G3 for longitudinal perforation and lateral perforation, differential mechanisms 61 and 62 of the identical construction are interposed as shown in FIGS. 3 and 6. The differential mechanisms 61 and 62 have the same constructions as the differential mechanism 51 in the arbitrarily positioned lateral perforation forming apparatus 9. Respective differential shafts 63 and 64 are respectively driven to rotate by servo motors 65 and 66 to cause variations of rotational phases of gears 69 and 70 on the output side relative to gears 67 and 68 on the input side to cause shifts of rotational phases of the respective pair of the longitudinal roulette cylinder 15 of the arbitrarily positioned longitudinal perforation forming apparatus 7 and the receptacle cylinder 16, and the lateral roulette cylinder 41 of the arbitrarily positioned lateral perforation forming apparatus 9 and the receptacle cylinder 42, relative to the rotational phase according to the drive shaft S of the machine. Thus, a position a of the longitudinal perforation 8 and the lateral perforation 10 in the longitudinal direction (traveling direction of the continuous web paper) is varied relative to the lateral perforation for fold line. In the shown embodiment the gear 69 and the input gear 26 of the longitudinal perforation apparatus 7 are used in common. The speed, number and direction of rotation of servo motors 65 and 66 of the differential mechanism 61 and 62 interposed in respective gear trains G2 and G3 are adjusted manually.

Overall operation of the shown embodiment will be discussed hereinafter.

Figure 9:
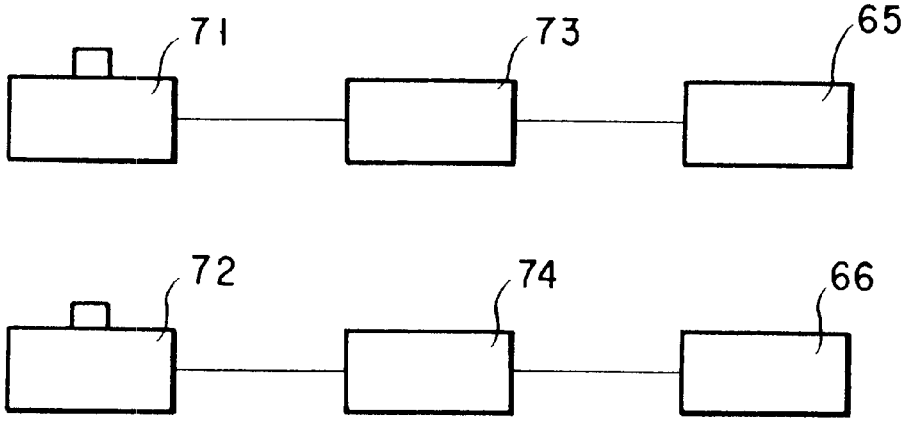
FIG. 9 is a block diagram showing one part of the control system in the shown embodiment.

A second control system includes a push button 71, a driver 73, and the servo motor 65 of FIG. 9. At first, the differential mechanisms 61 and 62 of the drive gear trains G2 and G3 respective of the arbitrarily positioned longitudinal perforation forming apparatus 7 and the arbitrarily positioned lateral perforation forming apparatus 9 are driven via push buttons 71 and 72, drives 73 and 74 and their servo motors 65 and 66, respectively, as shown in FIG. 9 to manually adjust their rotation for setting a selected position a of the longitudinal perforation 8 and the lateral perforation 10 relative to the lateral perforation 3 for the fold line.

The continuous web paper 2 is fed to travel in this manner. The continuous web paper 2 is formed with the lateral perforations for fold lines at a given interval by the lateral perforation forming apparatus 1 for a fold line. Then, in the continuous web paper 2, in sheet portions defined by the lateral perforations for fold lines, at the most upstream side portion of the sheet portion in which the longitudinal perforation 8 and the lateral perforation 10 are to be formed, the mark 12 is printed preliminarily.

Figure 10:
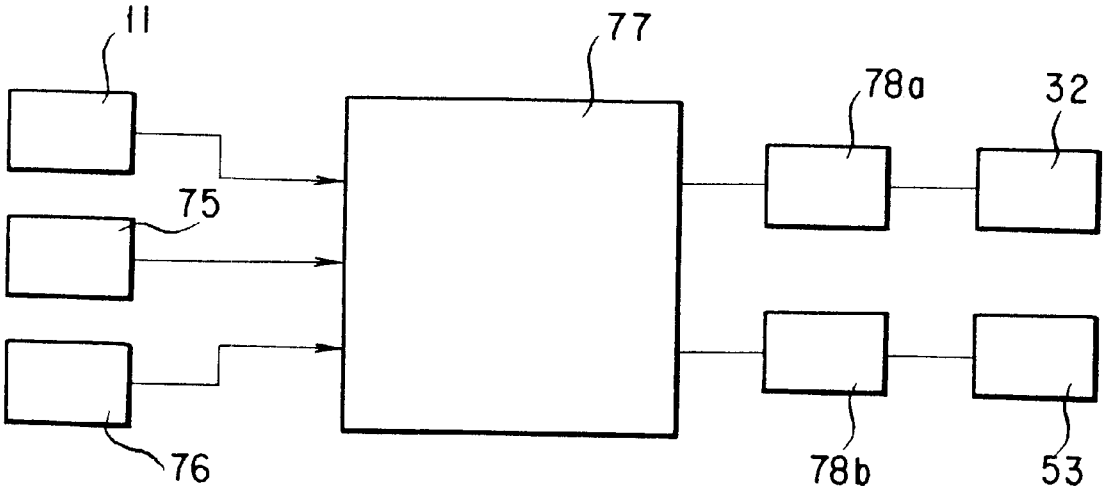
FIG. 10 is a block diagram showing another part of the control system in the shown embodiment.
Figure 11:
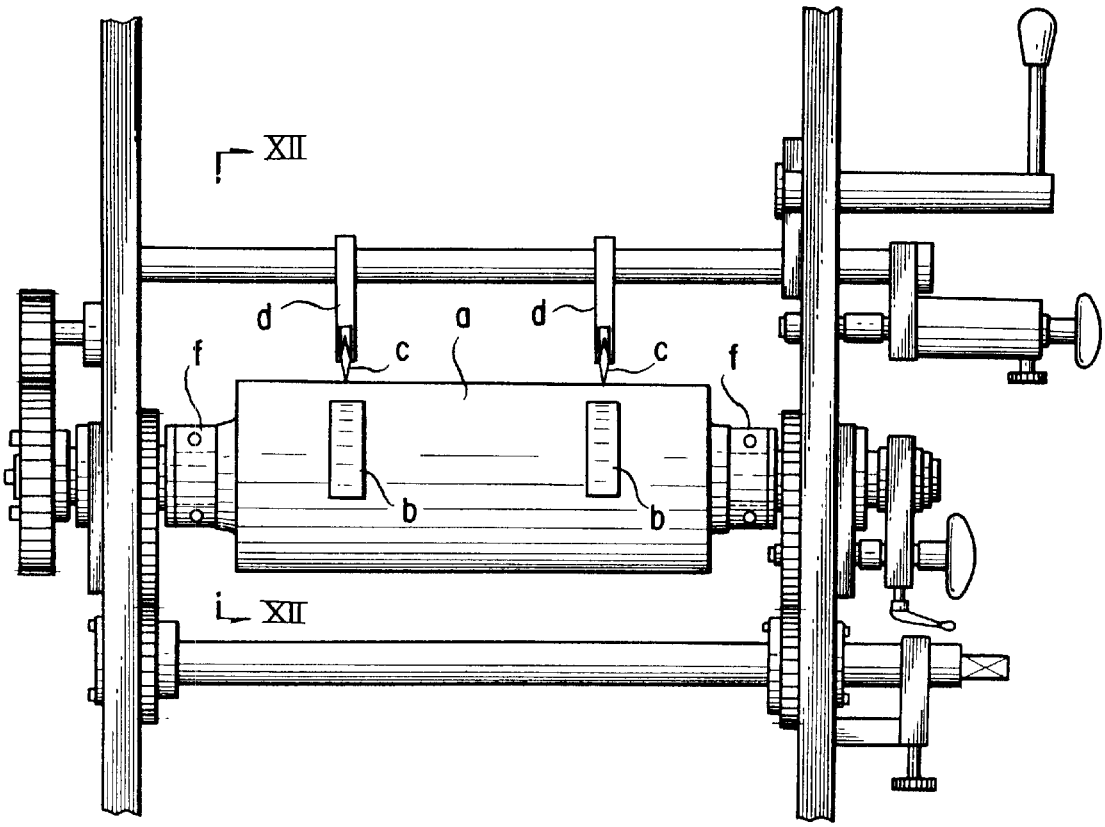
FIG. 11 is an explanatory illustration showing a conventional example of the longitudinal perforation forming apparatus.
Figure 12:
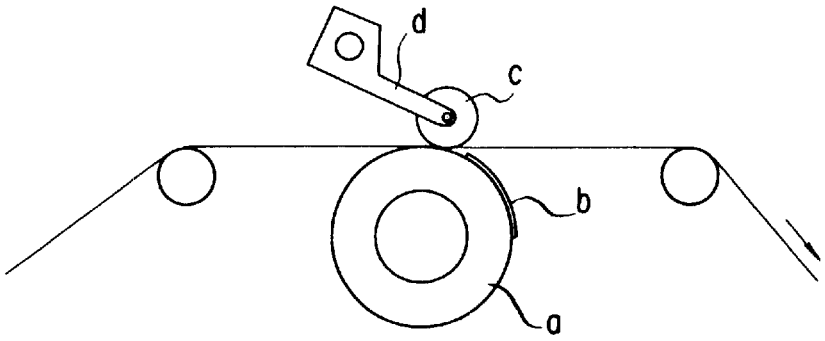
FIG. 12 is a section taken along line XI—XII of FIG. 11.

Then, when the mark 12 is read by the mark sensor 11, a measurement of the traveling distance of the continuous web paper 2 according to signals from an encoder 75 mounted on the drive system of the machine is initiated by the first control system shown in FIG. 10. A traveling distance from the mark sensor 12 to a respective one of perforation forming apparatus 7 and 9 are preliminarily set by a distance setting device 76. Then, inputs from the encoder 75 and the distance setting device 76 are arithmetically processed by the control unit 77. When the value of the signal from the encoder 75 becomes a set value, the switchover mounting device, including servo motors 32 and 53, is driven to rotate in a predetermined direction at predetermined rotation speeds for predetermined number of turns via drivers 78*a* and 78*b*.

By rotating both servo motors 32 and 53, the longitudinal perforation 8 having a length b starting from a position of a distance a from the lateral perforation 3 for fold line of the sheet portion where the mark 12 is placed is formed by the arbitrarily positioned longitudinal perforation forming apparatus 7, as shown in FIG. 2.

Next, by the arbitrarily positioned lateral perforation forming apparatus 9, the lateral perforation 10 is formed at a position of distance a from the lateral perforation 3 for fold line. After formation of the arbitrarily positioned perforations 8 and 10, respectively, the servo motors 32 and 53 are rotated respectively at the same rotation speed for the same number of turns in the reverse direction to cause phase shift of the edge receptacle portions relative to respective roulette edges so that perforations are not formed any more.

Thus, by detecting the presence or absence of mark 12 for each sheet portion, both perforations are formed at respectively selected positions only for the sheet portion, on which the mark 12 is preliminarily printed.

It should be noted that the positions of respective perforations may be determined from the mark 12 instead of the lateral perforation 3 for fold line.

In the shown embodiment, an embodiment employing both the arbitrarily positioned longitudinal perforation forming apparatus 7 and the arbitrarily positioned lateral perforation forming apparatus 9 has been illustrated. However, it is possible to employ only an arbitrarily positioned longitudinal perforation forming apparatus 7 as required.

In the shown embodiment, by sequentially arranging the arbitrarily positioned longitudinal perforation forming apparatus 7 and the arbitrarily positioned lateral perforation forming apparatus 9 in the traveling direction of the continuous web paper 2, the perforation in the longitudinal direction and the perforation in the lateral direction can be provided at selected positions in addition to the perforation for fold line, in the continuous web paper 2. For example, it is possible to form a portion surrounded by perforations. Therefore, a wide variation can be provided for specifications of processing of printing products.

Although the present invention has been illustrated and described with respect to an exemplary embodiment which is to be applied for the form printing machine or applicable for forming a longitudinal perforation, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. An apparatus comprising:

a longitudinal roulette cylinder including a first rotary shaft rotatably mounted so as to be located on a first side of a continuous web paper and so as to be rotatable in a travel direction of the continuous web paper, and including at least one disc-shaped longitudinal roulette edge supported by said first rotary shaft, each of said at least one longitudinal roulette edge being adapted to be movable in an axial direction of said first rotary shaft and to be held at a rotation position on said first rotary shaft;

a receptacle cylinder including a second rotary shaft rotatably mounted parallel to said first rotary shaft so as to be located on a second side of the continuous web paper and so as to be rotatable in a travel direction of the continuous web paper, and including at least one disc-shaped edge receptacle plate supported by said second rotary shaft, each of said at least one edge receptacle plate being adapted to be movable in an axial direction of said second rotary shaft and to be held at a rotation position on said second rotary shaft and having a projecting edge receptacle portion on an outer periphery thereof, wherein said longitudinal roulette cylinder and said receptacle cylinder are arranged such that said edge receptacle portion of said receptacle cylinder can oppose said longitudinal roulette edge of said longitudinal roulette cylinder so as to form a perforation in the continuous web paper;

a drive system for driving said first rotary shaft of said longitudinal roulette cylinder and said second rotary shaft of said receptacle cylinder in synchronism with the travel of the continuous web paper;

a switchover moving device adapted to engage each of said at least one edge receptacle plate and to move only said at least one edge receptacle plate in the axial direction of said second rotary shaft so as to move said at least one edge receptacle plate between an aligned rotation position, whereat said edge receptacle portion opposes said longitudinal roulette edge, and an offset rotation position, whereat said edge receptacle portion does not oppose said longitudinal roulette edge, said switchover moving device including:

a feeding screw arranged parallel to said second rotary shaft;

a sleeve threaded on said feeding screw and arranged so as to be prevented from rotating;

at least one shifting member attached to said sleeve and adapted to engage said at least one edge receptacle plate, each of said at least one shifting member having a groove in a peripheral surface thereof for holding one of said at least one edge receptacle plate therein, and having a cut-out portion in a periphery thereof for allowing said at least one edge receptacle plate to move along said second rotary shaft without interference from said at least shifting member, each of said at least one shifting member being attached to said sleeve by a removable fastening screw such that a position of said at least one shifting member on said sleeve is adjustable; and a switching drive source for rotating said feeding screw in a forward and reverse direction; and a first control system for controlling said switchover moving device, said first control system being connected to said switching drive source so as to control said switching drive source.

2. The apparatus of claim 1, further comprising:

a differential mechanism in said drive system;

a differential shaft connected to said differential mechanism for varying a rotation of said first rotary shaft and said second rotary shaft with respect to the travel of the continuous web paper by varying a rotation of said differential shaft; and a second control system for controlling a rotation of said differential shaft.

3. The apparatus of claim 2, further comprising a mark sensor for reading a mark on the continuous web paper and for sending a mark read signal to said first control system, said first control system being adapted to drive said switchover moving device after receiving the mark read signal from said mark sensor.

4. The apparatus of claim 1, further comprising a mark sensor for reading a mark on the continuous web paper and for sending a mark read signal to said first control system said first control system being adapted to drive said switchover moving device after receiving the mark read signal from said mark sensor.

* * * * *